US009004476B2

(12) United States Patent
Schmidt

(10) Patent No.: US 9,004,476 B2
(45) Date of Patent: Apr. 14, 2015

(54) MACHINE VISE PARALLEL WITH ANGLED EDGES

(75) Inventor: David L. Schmidt, Zimmerman, MN (US)

(73) Assignee: Kurt Manufacturing Company, Inc., Minneapolis, MN (US)

( * ) Notice: Subject to any disclaimer, the term of this patent is extended or adjusted under 35 U.S.C. 154(b) by 855 days.

(21) Appl. No.: 13/270,472

(22) Filed: Oct. 11, 2011

(65) Prior Publication Data

US 2013/0087963 A1 Apr. 11, 2013

(51) Int. Cl.
*B25B 1/24* (2006.01)

(52) U.S. Cl.
CPC ..... *B25B 1/2457* (2013.01); *B25B 1/2463* (2013.01)

(58) Field of Classification Search
CPC ..... B25B 1/00; B25B 1/04; B25B 1/20; B25B 5/00; B25B 5/02; B25B 5/145
USPC ..... 269/282, 43, 45, 246, 249
See application file for complete search history.

(56) References Cited

U.S. PATENT DOCUMENTS

| | | | | |
|---|---|---|---|---|
| 4,383,682 | A * | 5/1983 | Feinberg | 269/76 |
| 4,767,110 | A | 8/1988 | Yang | |
| 4,854,568 | A | 8/1989 | Baeza et al. | |
| 5,037,075 | A | 8/1991 | Durfee, Jr. | |
| 5,193,791 | A | 3/1993 | Schwarz | |
| 5,419,540 | A | 5/1995 | Teafatiller | |
| 5,499,802 | A * | 3/1996 | Haberle | 269/99 |
| 6,464,216 | B2 * | 10/2002 | Weaver et al. | 269/282 |
| 6,672,578 | B1 * | 1/2004 | Martens | 269/282 |
| 6,681,464 | B1 * | 1/2004 | Dupuis et al. | 29/281.1 |
| 7,722,019 | B2 * | 5/2010 | Losi et al. | 269/9 |
| 2013/0087963 | A1 * | 4/2013 | Schmidt | 269/282 |

FOREIGN PATENT DOCUMENTS

JP 2000288852 A 10/2000

* cited by examiner

*Primary Examiner* — Lee D Wilson
(74) *Attorney, Agent, or Firm* — Westman, Champlin & Koehler, P.A.; Steven M. Koehler

(57) ABSTRACT

A work orienting plate or angled vise parallel for use with a machine vise and which angled plate has first, second and third reference edges with the second and third reference edges being spaced apart side edges that are perpendicular to the first edge. Angled work piece support edges join the second and third reference edges, respectively. The angled work piece support edges are at different angles from one another so that a work piece can be supported on any one of the edges relative to a reference surface of a vise on which the work orienting plate is mounted to position the work piece at selected angles for machining angled surfaces.

15 Claims, 6 Drawing Sheets

MACHINE VISE PARALLEL WITH ANGLED EDGES

BACKGROUND OF THE DISCLOSURE

The present disclosure relates to a vise parallel or support for positioning a work piece in a vise or similar clamping device at precisely set angles selectable by the user to provide a quickly changed support to hold and orient a work piece at a selected one of a plurality of preset angles.

In the prior art, various sine bars or sine blocks have been used for precisely setting angles for work pieces held in a vise or clamp. Sine bars are usually provided with a support of precise length, and by inserting precision gauge blocks under the supports, the precise angle of the flat surface of the sine bar can be set using known geometry principals. The height of the gauge blocks needed to achieve a desired angle is generally determined from a machinist handbook, which has a set of tables giving dimensions for setting the angle of a bar of known length, usually five inches.

It has been found that for the majority of parts that are to be machined at an angle, the angles of cut relative to a reference plane will be 30, 45, 60 or 90 degrees. Having the ability to quickly position a part at one of these common angles can greatly simplify the set up time for machining a part.

Use of sine bars and gauge blocks for setting the correct angle is time-consuming, and requires a certain amount of skill to make sure that there are no foreign materials or the like on the gauge blocks that might change the angle setting of the support surface of the sine bar.

SUMMARY OF THE DISCLOSURE

The present disclosure relates to a machine vise parallel or work piece orienting plate that is a flat plate section of desired thickness provided with a base edge, and two spaced, parallel side edge surfaces at precisely 90 degrees to the base edge. The base edge and the two side edges function as reference edges. The vise parallel of the present disclosure also has at least one, and as shown two angled edges. As shown one angled edge is at 45 degrees relative to one of the side edges and the other angled edge is at 30 degrees to the other side edge. The angled edges are precisely made, relative to the reference base and side edges. The vise parallel of this disclosure is called an angled parallel, and is of size to mount on a fixed jaw of a vise or clamp. The angled parallel has a mounting slot or opening in center portions for a screw that is used for holding the angled parallel against a fixed jaw in four different orientations providing support edges that will hold a piece part to be machined at the desired angle. The angles of the support edges are selected as special angles for runs of individual parts that are to be machined, or as disclosed the support edges can be machined at the most commonly used angles of 30, 45, 60 or 90 degrees relative to a reference plane. The angled parallel is retained on a fixed jaw utilizing a threaded screw that passes through the provided opening and holds the angled parallel in its desired positions. In each position a reference edge of the angled parallel will rest upon a reference surface, such as the surface of a flat vise parallel resting on upper surfaces of vise rails so that the angled edges of the angled parallel are properly oriented relative to the vise or other clamp. The reference surface can be the top surface of a machine vise rail, if desired.

All that is required for changing the support angle at which a work piece will be held is to remove the screw that retains the angled parallel on the vise jaw, and then rotating the angled parallel to the desired position and reinserting the screw. The angled parallel will stay attached to the fixed jaw, and is positioned in contact with the reference surface of the vise or clamp so that it is always precisely positioned.

The angled parallel can be used to locate parts vertically for working on the ends of the part, and can also function as a work stop on the vise jaw. Its low profile design and the ability to install it in just moments saves a great amount of time between set ups. The easily mounted angled parallel replaces the need for bulky, hard to adjust work stops.

DETAILED DESCRIPTION OF ILLUSTRATIVE EMBODIMENTS

Figure 1:
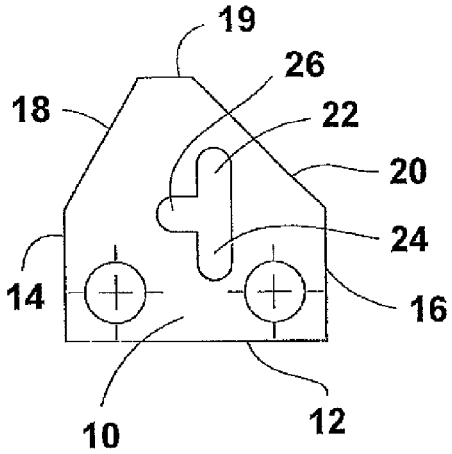
FIG. 1 is a plan view of an angled parallel made according to the present disclosure.
Figure 2:
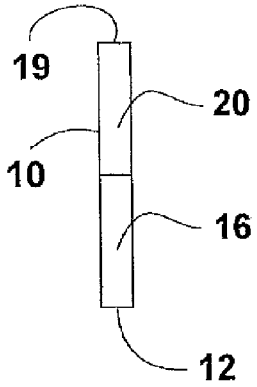
FIG. 2 is an edge view thereof.

FIGS. 1 and 2 show an angled parallel or work piece orienting plate 10 made according to the present disclosure which is a small, flat metal plate portion or section that as shown is machined to have three reference straight edges including a first or base reference edge 12, and second and third side reference edges 14 and 16 that are spaced apart and precisely perpendicular (at 90 degrees) to the first or base reference edge 12. The reference edges define a width of the angled parallel.

The angled parallel 10 further has an angled support edge 18 machined at an angle of 30 degrees relative to the second reference side edge 14, or at an angle of 60 degrees relative to the base reference edge 12. Edge 18 intersects the side edge 14 at a location spaced upwardly from the base reference edge 12 and extends toward the center of the vise parallel and in direction away from reference edge 12. A second angled edge 20 is machined at a 45 degree angle relative to the third reference side edge 16 and thus at an angle of 45 degrees relative to the base reference edge 12. The angled edge 20 intersects the edge 16 at a location spaced upwardly from the base reference edge 12 and extends toward the center of the angled parallel, in direction away from the reference edge 12. A short edge 19 is parallel to base edge 12, and is between the distal ends of the angled edges 18 and 20. The angled parallel 10 has a mounting opening 22 that as shown has a slot portion 24 and a side or ear portion 26 that receive a screw 28 that is indicated in dotted lines in FIG. 1. The slot and ear positions are such that the center of the screw can be used for clamping the angled parallel in position when it is resting on a reference surface of a vise or clamp. The length of the side edges 14 and 16 is sufficient to provide a stable support when the side edges are used for the supporting edges for the angled parallel 10.

The shape of the opening 22 is thus selected to insure that a single position for the mounting screw on the fixed vise jaw will permit mounting the angled parallel against a reference surface on the vise, such as the top surface of the vise rail, or as preferred, resting on a precision, standard machine vise flat parallel 50, shown in FIGS. 3-8.

Figure 3:
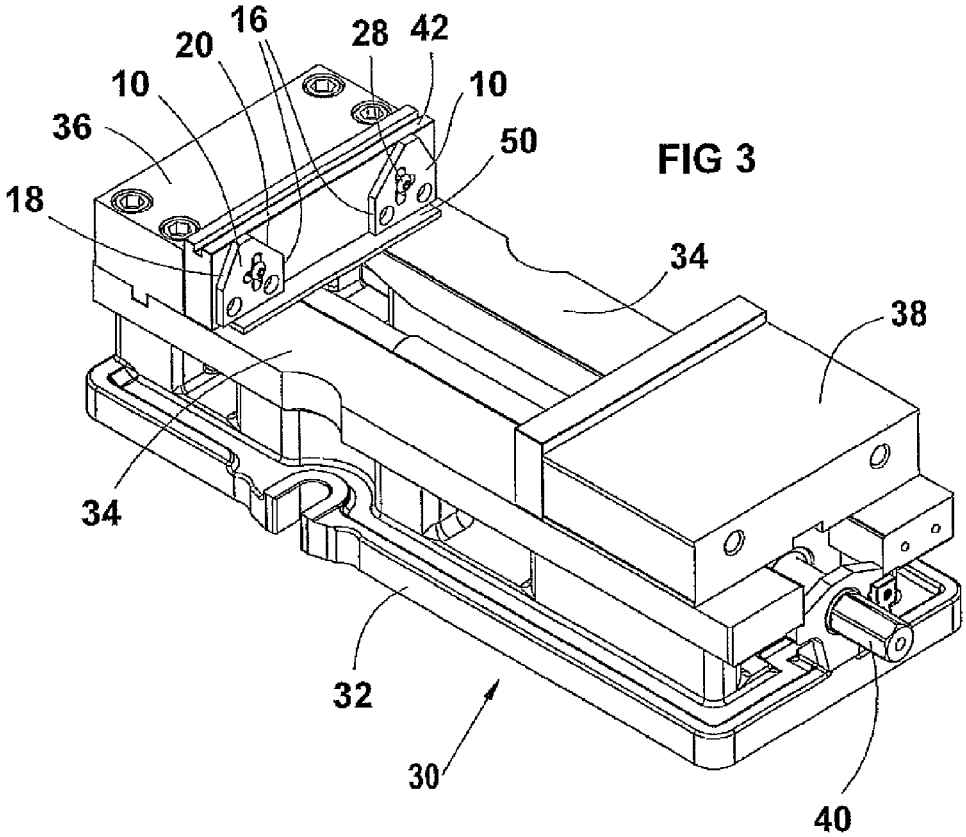
FIG. 3 is a perspective view of a typical machine vise showing a pair of angled parallels in position on a fixed vise jaw.

FIG. 3 illustrates a typical machine vise 30 having a base 32, and side rails 34 that mount a fixed jaw 36 at one end. A movable jaw 38 that can be used for clamping work pieces against the fixed jaw 36 is moved along the rails 34 with a vise screw 40 or other conventional clamping member. The fixed jaw 36 has a jaw plate 42 mounted thereon, and the jaw plate is generally mounted with two capscrews, in the position shown in FIG. 8. However, when using the angled parallels 10, special capscrews 44 are provided which have heads that clamp the jaw plate 42 in position on the fixed jaw 36, and which have a threaded bore 46 in the capscrew head into which a separate screw 28 can be threaded. The screw 28 has a button or other type of head that bears against the surface of the angled parallel to clamp it against the jaw plate 42, which is a part of a fixed jaw 36.

Vise parallel 50 that supports the angled parallels 10 is of conventional design. It is called a flat parallel in this description to differentiate it from the angled parallel 10 of the present disclosure. The upper surfaces of the vise rails 34 form a support plane and the flat parallel 50 is resting on the upper surfaces of the vise rails 34 so the flat parallel 50 forms a reference surface on which the reference base and side edges of the angled parallel 10 can be supported in use. The flat parallel 50 spans the space between the vise rails 34 and can support a work piece that is to be worked on and which is resting on an angled edge of an angled parallel 10. The work piece is clamped by moving the movable jaw 38 against the work piece in a conventional manner (See FIG. 8).

Figure 4:
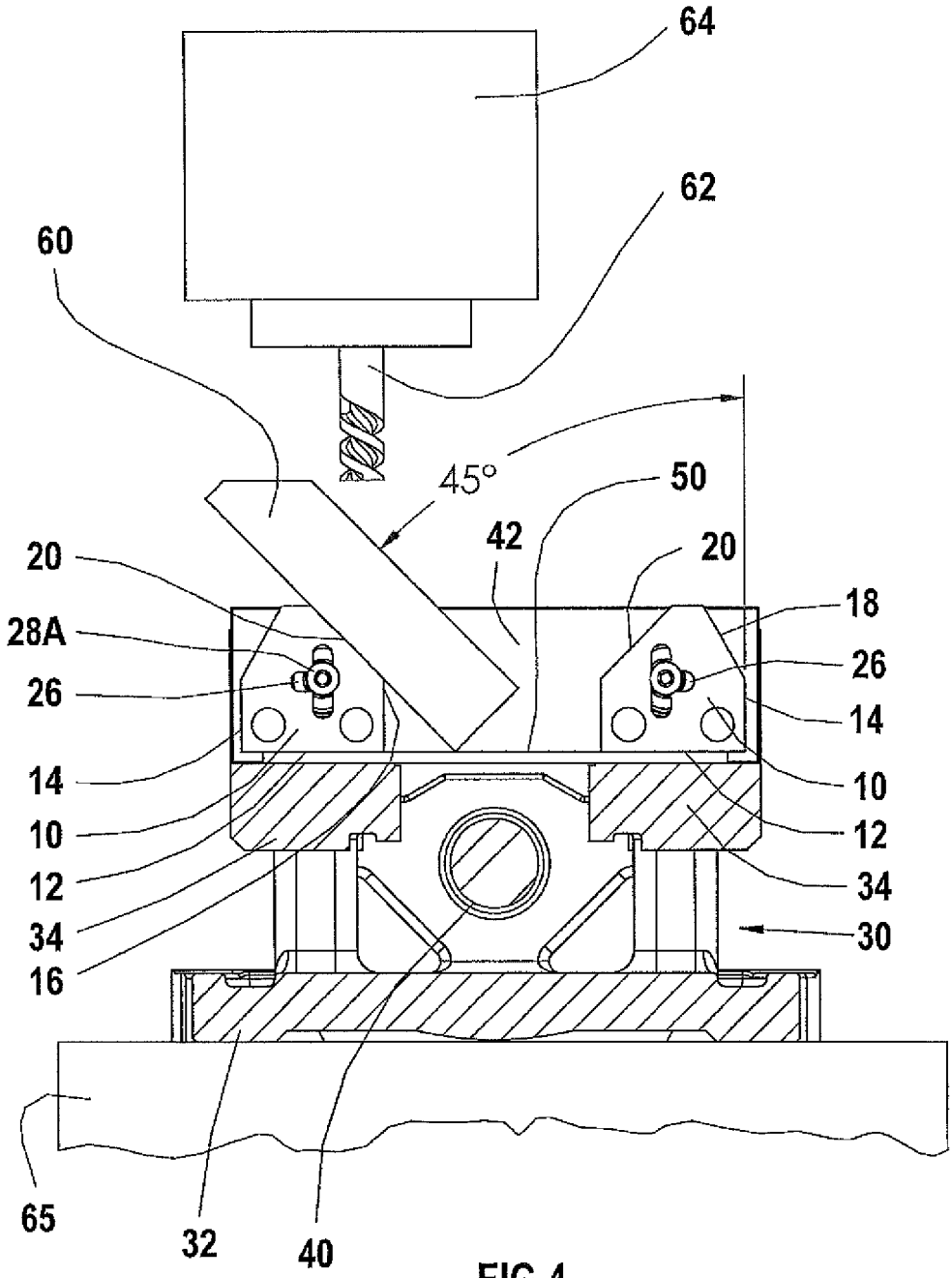
FIG. 4 is a sectional view of the vise of FIG. 3 viewed toward the fixed vise jaw with a work piece shown in a position along a first angled edge of one of the angled parallels mounted on the fixed vise jaw.

In FIG. 4, a typical work piece 60 is illustrated, and one end corner is supported on flat parallel 50 and the work piece is resting against reference surface 20 of the illustrated angled parallel 10 installed on the left hand side of the fixed jaw 36. The work piece 60 is held at a 45 degree angle relative to the reference edge 16, and also relative to the surface of the flat parallel, as shown, and is clamped in the vise 30. A machine tool cutter or grinder illustrated schematically at 62 powered from a machine tool shown fragmentarily at 64 is provided, and a tool table shown schematically at 65 of the machine tool can be used to move the vise so that the cutter 62 will cut a surface on the work piece 60 at the desired angle.

The angled parallel on the right hand side of the fixed vise jaw in FIG. 4 can be also used for positioning a work piece as desired, and if desired only one of the angled parallels need be mounted on the fixed jaw 36.

Figure 5:
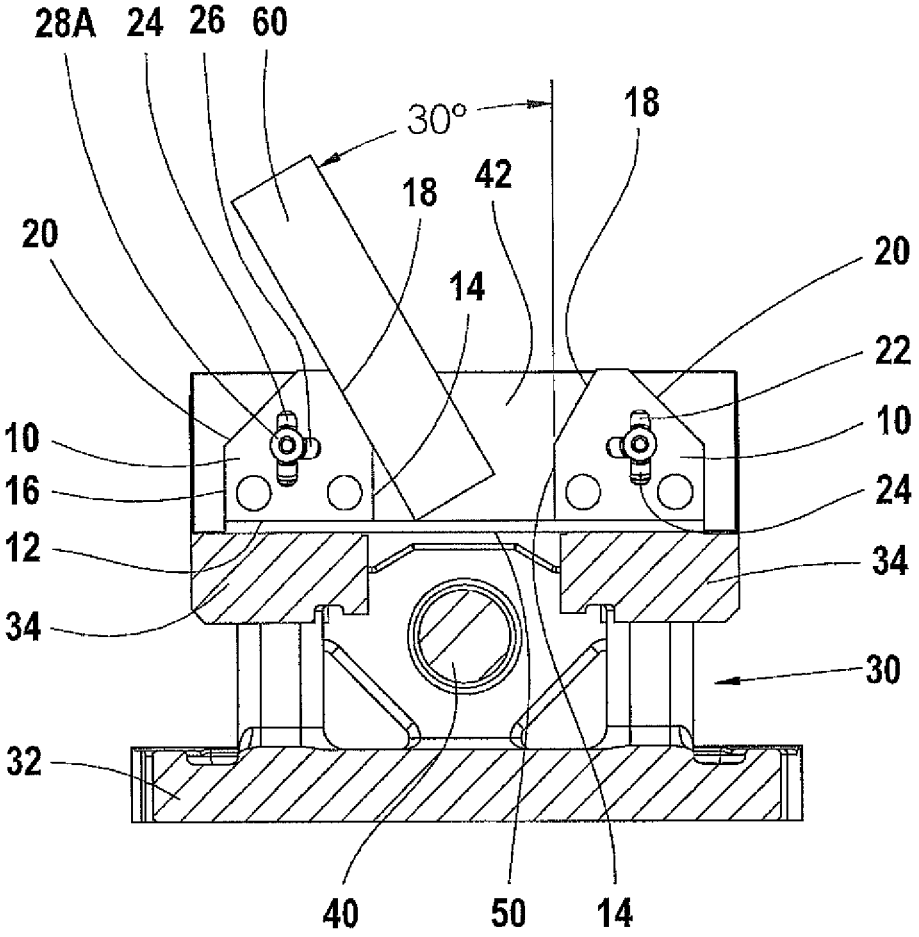
FIG. 5 is a fragmentary view similar to FIG. 4 with a work piece shown in position on a second angled edge of the angled parallel.

In FIG. 5, the work piece 60 is shown against the angled edge or surface 18, and the work piece 60 is again supported on a flat parallel 50. The angled parallel 10 in FIG. 5 is rotated 180 degrees about a vertical axis (flipped over) from the position shown in FIG. 4, which places the angled edge 18 toward the center of the vise jaw. Again, this is a 30 degree angle from vertical or relative to reference edge 14, or 60 degrees measured from the reference surface of flat parallel 50. This shows a second position of the work piece using the same angled parallel for orienting the work piece in position.

Figure 6:
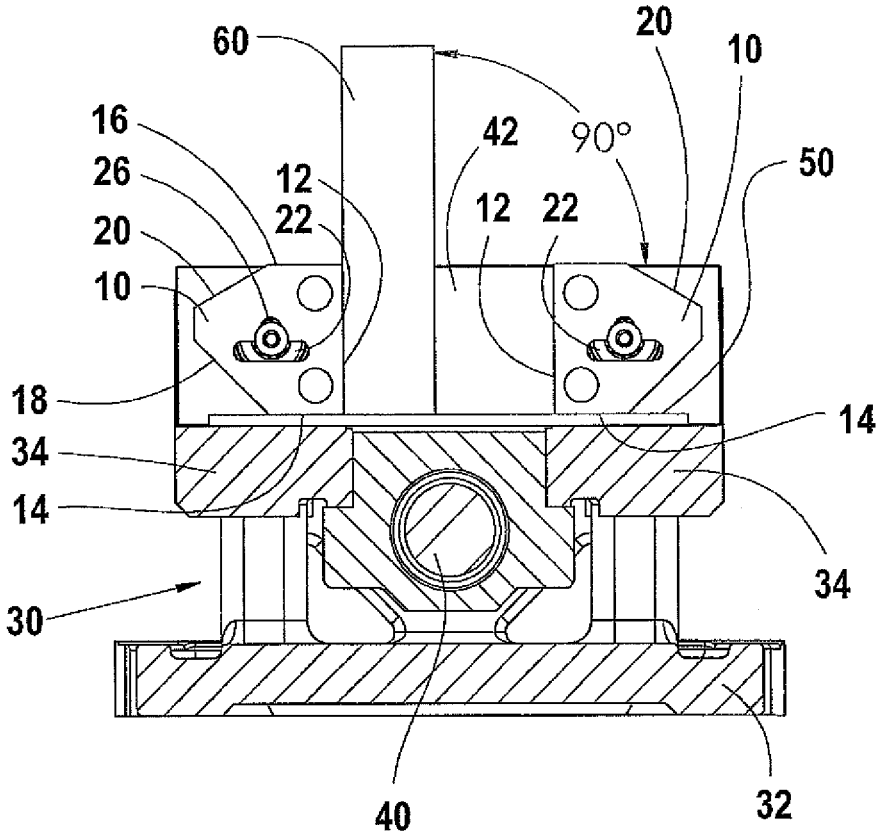
FIG. 6 is a view similar to FIG. 4 showing a third position of an angled parallel positioning a work piece for machining.

In FIG. 6, the angled parallel 10 supporting work piece 60 is positioned with the base reference edge 12 vertical, using the reference edge 14 to rest on the top surface of the flat parallel 50 or on the top surface of the vise rail, if the flat parallel is not used. The opening 22 accommodates the screw 28 in this orientation to properly position the surface 12 at 90 degrees to the plane of the upper surface of flat parallel 50 and of the vise rails.

Again, the work piece 60 is held at 90 degrees to the plane of the support surface of the flat parallel 50 in this position and can be clamped with the movable jaw 38 for operations with a machine tool cutter or grinder 62.

Figure 7:
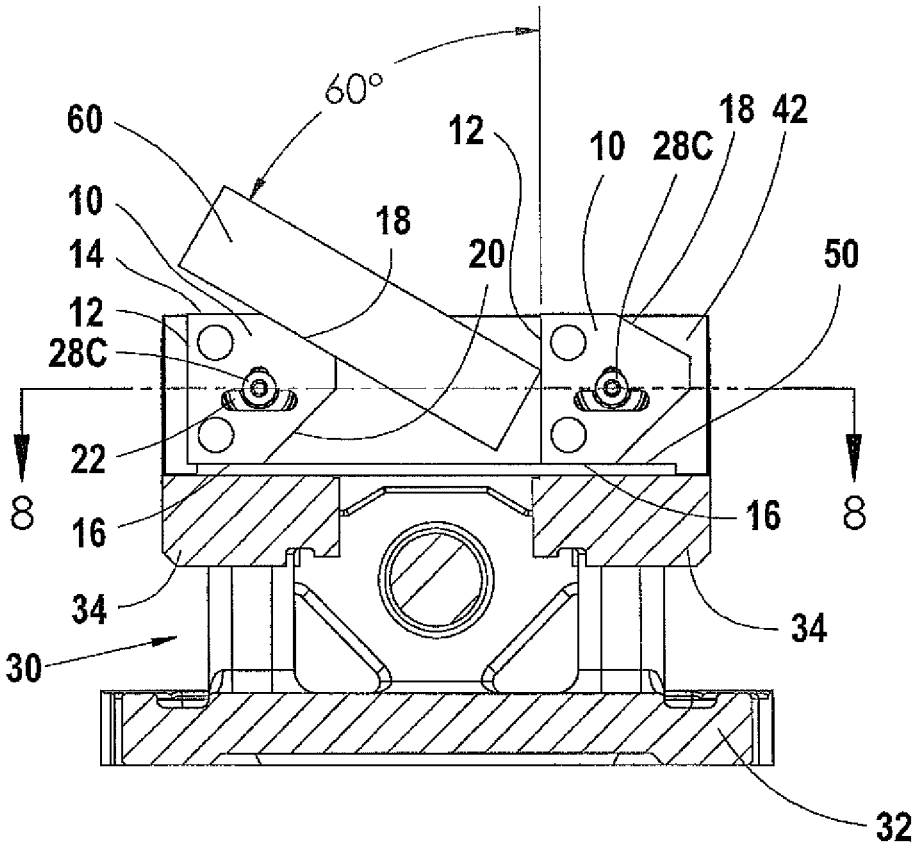
FIG. 7 is a view similar to FIG. 5 showing a fourth position for holding a work piece using the angled parallel of the present disclosure.

A fourth position of the angled parallel 10 for cutting a surface of a work piece 60 held at a 60 degree angle relative to the vertical is illustrated in FIG. 7. The head of screw 28 bears against the surface of the angled parallel and clamps it tightly against the fixed jaw, through jaw plate 42.

In the FIG. 7 position of the left side angled parallel 10, the side reference surface 16 is rested on the upper surface of the flat parallel 50 or other reference surface, such as the top of one vise rails 34. Also, it can be seen the base surface 12 of the angled parallel on the right hand side of the fixed jaw is vertical and can be used as a stop for the work piece 60.

Figure 8:
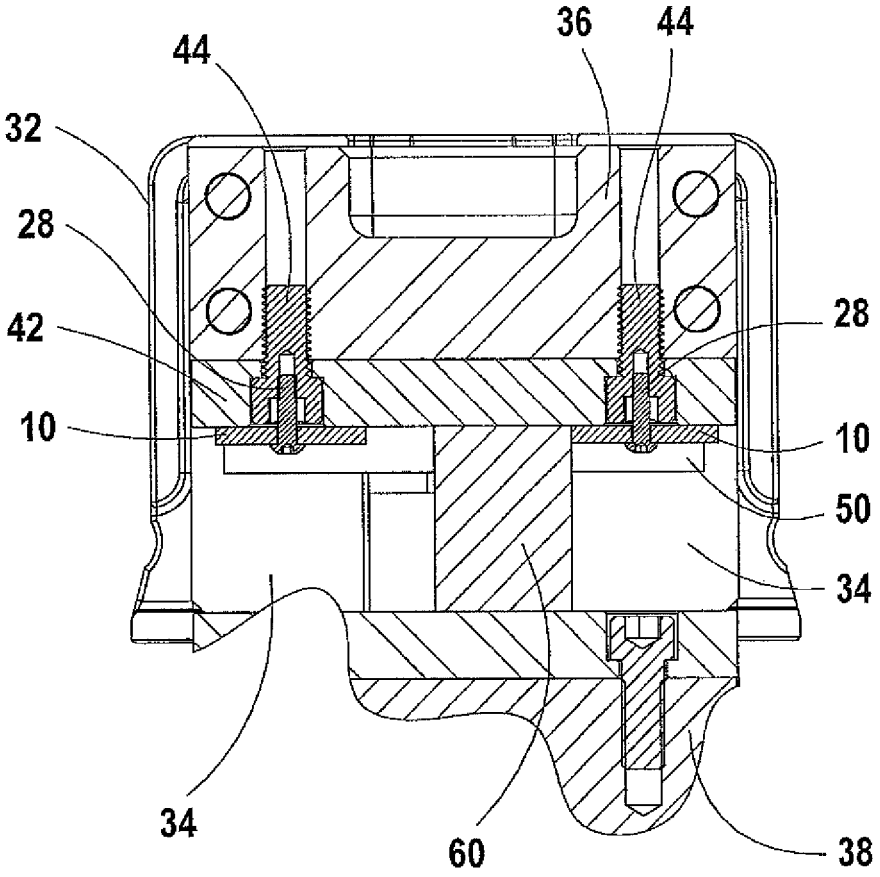
FIG. 8 is a fragmentary sectional view taken as on line 8-8 as in FIG. 7.

FIG. 8 is a sectional view through the fixed jaw 36 carrying the jaw plate 42, which is part of the fixed jaw, and the work piece 60 is shown fragmentarily in section clamped by the movable jaw 38 shown fragmentarily. As can be seen the side of the work piece extends outwardly from the fixed jaw beyond flat parallel 50 so that the movable jaw 38 can clamp the work piece between the fixed jaw and movable jaw while the work piece rests on an appropriate angled surface of the angled parallel.

The angled parallel or work piece positioner 10 is preferably formed from a square piece of flat metal having precise 90 degree edges, and with the sides having a length no more than the height of the jaw plate or fixed jaw on which it is to be mounted, so that the angled parallel formed does not protrude above the fixed jaw in any of the positions used to provide the desired angled support edge in a working position. It is made so that when one edge rests on a reference surface of the vise or clamp, such as in the top of a flat parallel rested on the vise rails or on a vise rail itself, the angled parallel is preferably no higher than the upper edge of the vise jaw plate 42.

Then, the angled edges of the angled parallel used to support a work piece are machined, preferably, as shown at 45 and 30 degrees to the side edge that the angled edge intersects. The angles shown are the most common angles needed for supporting a work piece for machining operations. The angled edges are started at a level spaced from the base edge 12 so that the respective side edges 14 and 16 have enough length to satisfactorily support the angled parallel on the reference surface of the vise so that the angled edges are positioned precisely before the screw 28 holding the angled parallel in that position is tightened. A feature is that the angled parallel can stay attached to the fixed jaw and stay in contact with the parallel 50 or other reference surface of the vise when work pieces are changed.

While the size of the angled parallel may vary, it is desirable to have the top edge of the parallel no higher than the top of the vise jaw with which it is being used.

Although the present invention has been described with reference to preferred embodiments, workers skilled in the art will recognize that changes may be made in form and detail without departing from the spirit and scope of the invention.

What is claimed is:

1. An angled vise parallel for supporting work pieces in a clamp comprising a flat smooth plate portion defined by first, second and third reference edges, the second and third reference edge being spaced apart, parallel and perpendicular to the first reference edge, a fourth support edge intersecting the second reference edge and extending in direction away from the first reference edge and toward a center portion of the plate portion at a pre-determined selected angle relative to the first reference edge, and a fifth support edge on the plate portion intersecting the third reference edge and extending in direction away from the first reference edge and toward the center of the plate portion at a second angle relative to the first reference edge different from the first angle.

2. The angled vise parallel of claim 1, and an opening in center portions of the plate portion, for receiving a fastener passing through the opening.

3. The angled vise parallel of claim 2, wherein said opening comprising a first slot portion, extending with a slot axis generally perpendicular to the first reference edge, and a second slot portion intersecting the first slot portion and extending substantially parallel to the first reference edge.

4. The angled vise parallel of claim 1, wherein the plate portion has a sixth edge parallel to the first reference edge and intersecting the fourth and fifth support edges, said sixth edge being spaced from the first edge substantially the same distance as a distance between the second and third reference edges.

5. The angled vise parallel of claim 4 wherein said sixth edge is substantially shorter than the first, second and third reference edges.

6. The angled vise parallel of claim 1 wherein the plate portion has a central opening configured to receive a screw centered at clamping positions in the opening that are the same distance from the first, second and third reference edges, and the central opening being further configured so a head of a screw engages surfaces of the plate portion in each of the clamping positions.

7. For use in combination with a clamp jaw, the clamp jaw having a width and a height, the height of the clamp jaw extending above a reference surface on a clamp on which the clamp jaw is mounted, the improvement comprising a work piece orienting plate having a width and height not substantially greater than the height of the clamp jaw, said work piece orienting plate having a first edge and second and third edges perpendicular to the first edge and spaced apart to define the width of the work piece orienting plate, a fourth edge on the work piece orienting plate formed at a first angle relative to and intersecting the second edge of the work piece orienting plate, a fifth edge formed on the work piece orienting plate at a second angle relative to and intersecting the third edge of the work piece orienting plate, said second angle being different from the first angle, and an opening in portions of the work piece orienting plate through which a screw can pass to hold the work piece orienting plate relative to the clamp jaw.

8. The work orienting plate of claim 7, further characterized by said opening being irregularly shaped to permit a screw engaged and secured relative to the clamp jaw to hold the work orienting plate relative to the clamp jaw with any one of the three reference surfaces engaging the reference surface of the clamp.

9. A machine tool parallel for mounting on a vise jaw comprising a flat metal parallel having a reference base edge, a first side edge perpendicular to the base edge, a second side edge perpendicular to the base edge and spaced from the first side edge, and an angled edge intersecting the side edge at a location spaced along the first side edge from the base edge and extending laterally from the first side edge at a preselected angle relative to the first side edge such that the angled edge extends away from both the first side edge and the base edge, and an opening for a fastener in portions of the machine tool parallel oriented so a fastener extending through the opening may be centered at the same distance from the base edge and the second side edge.

10. The machine parallel of claim 9 wherein the angled edge comprises a first angled edge and further comprising a second angled edge intersecting the second side edge at a location spaced from the base edge and extending at a preselected angle relative to the second side edge such that the second angled edge extends away from both the second side edge and the base edge.

11. The machine tool parallel of claim 10, wherein the machine tool parallel has a distal edge spaced from and parallel to the base edge, the distal edge extending between distal ends of the first and second angled edges.

12. The machine tool parallel of claim 11, further characterized by the base edge and the distal edge being spaced apart the same distance as a distance between the first and second side edges.

13. The machine tool parallel of claim 12 wherein the distance between the base and distal edges is no greater than a height of a vise jaw on which the machine tool parallel is used.

14. The machine tool parallel of claim 9 wherein the flat metal parallel is square in outer configuration before the angled edge is formed.

15. The machine tool parallel of claim 10 wherein the first angled edge extends from the first side edge at an angle of 30 degrees and the second angled edge extends from the second side edge at an angle of 45 degrees.

* * * * *